US008789919B2

(12) United States Patent
Mita

(10) Patent No.: US 8,789,919 B2
(45) Date of Patent: Jul. 29, 2014

(54) INKJET HEAD, INKJET HEAD CLEANING SYSTEM AND MAINTENANCE METHOD OF INKJET HEAD

(75) Inventor: Tsuyoshi Mita, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 11 days.

(21) Appl. No.: 13/431,117

(22) Filed: Mar. 27, 2012

(65) Prior Publication Data

US 2012/0249673 A1 Oct. 4, 2012

(30) Foreign Application Priority Data

Mar. 28, 2011 (JP) ..... 2011-070968

(51) Int. Cl.
*B41J 2/165* (2006.01)

(52) U.S. Cl.
USPC ..... 347/33; 347/28

(58) Field of Classification Search
USPC ..... 347/33
See application file for complete search history.

(56) References Cited

U.S. PATENT DOCUMENTS 6,291,545 B2 * 9/2001 Imamura ..... 522/181
2010/0238236 A1 * 9/2010 Uchiyama ..... 347/45
2010/0245466 A1 * 9/2010 Inoue ..... 347/30
2011/0109691 A1 * 5/2011 Sato et al. ..... 347/33
2013/0057613 A1 3/2013 Inoue

FOREIGN PATENT DOCUMENTS

JP 2005-111808 A 4/2005
JP 2005-238611 A 9/2005
JP 2006-142621 A 6/2006
JP 2007-83496 A 4/2007
JP 2010-234668 A 10/2010

OTHER PUBLICATIONS

Japanese Office Action dated Apr. 26, 2013, issued in Japanese patent application No. 2011-070968.

* cited by examiner

*Primary Examiner* — Alessandro Amari
*Assistant Examiner* — Justin Seo
(74) *Attorney, Agent, or Firm* — Birch, Stewart, Kolasch & Birch, LLP

(57) ABSTRACT

An inkjet head includes: a plurality of nozzle plates which are arranged in a width direction of a recording medium and each of which has a plurality of nozzles for ejecting ink and has a hydrophobic property; and cleaning liquid holding members which are provided respectively on both sides of the plurality of nozzle plates in terms of a direction perpendicular to a direction of arrangement of the plurality of nozzle plates so as to extend substantially in parallel with the direction of arrangement of the plurality of nozzle plates, and which have a lower hydrophobic property than the plurality of nozzle plates, wherein the cleaning liquid holding members include a cleaning liquid holding mechanism for holding cleaning liquid.

8 Claims, 15 Drawing Sheets

INKJET HEAD, INKJET HEAD CLEANING SYSTEM AND MAINTENANCE METHOD OF INKJET HEAD

BACKGROUND OF THE INVENTION

1. Field of the Invention

The present invention relates to an inkjet head, an inkjet head cleaning system and a maintenance method of an inkjet head, and more particularly, to an inkjet head, an inkjet head cleaning system and a maintenance method of an inkjet head, which each facilitate the cleaning of a nozzle surface by a wiping member while a member that holds cleaning liquid is provided in the vicinity of the nozzle surface of an inkjet head.

2. Description of the Related Art

With use, foreign matter of various types, such as ink residue, paper dust, or the like, adheres to the nozzle surface of an inkjet head which is used in an inkjet recording apparatus. If foreign matter adheres to the nozzle surface, ink droplets ejected from the nozzles are affected, variation occurs in the ejection direction of the ink droplets, it becomes difficult to deposit the ink droplets at the prescribed positions on a recording medium, and this becomes a cause of decline in the image quality. Therefore, in an inkjet recording apparatus, it is important to remove foreign matter periodically by means of a maintenance method, such as a wiping method, or the like.

For example, Japanese Patent Application Publication No. 2005-238611 and Japanese Patent Application Publication No. 2005-111808 describe a method of cleaning a nozzle plate by abutting a cleaning material impregnated with cleaning liquid against the whole surface of a nozzle plate. Furthermore, Japanese Patent Application Publication No. 2006-142621 discloses an inkjet application apparatus including a spraying mechanism for spraying solvent onto a nozzle surface and a mechanism for wiping the nozzle surface, wherein cleaning liquid is sprayed from the nozzles and wiping is performed.

However, in the apparatuses described in Japanese Patent Application Publication No. 2005-238611 and Japanese Patent Application Publication No. 2005-111808, since cleaning liquid is deposited directly on the cleaning material, then it is difficult to adjust the cleaning liquid. Furthermore, a nozzle surface is normally formed with hydrophobic properties in order to prevent the adherence of ink. Consequently, in the apparatus described in Japanese Patent Application Publication No. 2006-142621, even if cleaning liquid is sprayed onto a nozzle surface, then there is a possibility that the cleaning liquid runs off the nozzle surface and the surface is wiped in a state where there is no cleaning liquid deposited thereon because the nozzle surface has hydrophobic properties. Because wiping is carried out in a state where there is no cleaning liquid deposited on the nozzle surface, there is also a further problem in that the hydrophobic film on the nozzle surface is degraded.

SUMMARY OF THE INVENTION

The present invention has been contrived in view of these circumstances, an object thereof being to provide an inkjet head, an inkjet head cleaning system and a maintenance method of an inkjet head whereby the amount of cleaning liquid contributing to a nozzle surface is increased and the durability of a hydrophobic film is improved.

One aspect of the invention is directed to an inkjet head comprising: a plurality of nozzle plates which are arranged in a width direction of a recording medium and each of which has a plurality of nozzles for ejecting ink and has a hydrophobic property; and cleaning liquid holding members which are provided respectively on both sides of the plurality of nozzle plates in terms of a direction perpendicular to a direction of arrangement of the plurality of nozzle plates so as to extend substantially in parallel with the direction of arrangement of the plurality of nozzle plates, and which have a lower hydrophobic property than the plurality of nozzle plates, wherein the cleaning liquid holding members include a cleaning liquid holding mechanism for holding cleaning liquid.

According to this aspect of the present invention, since a cleaning liquid holding device which holds cleaning liquid is provided substantially in parallel with the direction of arrangement of the nozzle plates, then when the nozzle surface is wiped with a wiping member, the nozzle plates can be cleaned while the wiping member causes the cleaning liquid held by the cleaning holding members to propagate. Consequently, it is possible to prevent the nozzle plates from being wiped in a state where the nozzle plates are not impregnated with cleaning liquid, and therefore deterioration of the hydrophobic properties (a hydrophobic film) of the nozzle plates can be prevented.

Desirably, the cleaning liquid holding mechanism is constituted by groove sections formed in the cleaning liquid holding members.

According to this aspect of the present invention, since groove sections are provided as a mechanism for holding the cleaning liquid, then the cleaning liquid can be held in the groove sections by capillary action.

Desirably, the groove sections are formed substantially in parallel with the direction of arrangement of the plurality of nozzle plates.

According to this aspect of the present invention, since groove sections are provided in parallel with the direction of arrangement of the nozzle plates, then it is possible to reduce the resistance during wiping, by wiping with the wiping member in the same direction as the direction of arrangement of the nozzle plates. Consequently, it is possible to prevent the wiping member from catching on the grooves and to prevent the occurrence of vibration due to resistance. Furthermore, it is also possible to apply the cleaning liquid continuously in a stable manner at all times, in the wiping direction.

Desirably, from among the groove sections provided on the both sides of the plurality of nozzle plates, the groove section on one side has a guidance groove extending towards the plurality of nozzle plates, and the groove section on another side has a groove extending in a different direction from the guidance groove.

According to this aspect of the present invention, since the direction of a groove of a holding member on one side is provided so as to be a guiding configuration which leads the cleaning liquid toward the nozzle surface and a groove on the other side is oriented in another direction, then it is possible to convey the cleaning liquid efficiently to the nozzle plates.

Desirably, the plurality of nozzle plates have a nozzle surface provided at an inclination with respect to a horizontal plane, and volume of the groove sections becomes larger as an angle of inclination of the nozzle surface increases.

According to this aspect of the present invention, if the nozzle surface is provided at an inclination with respect to the horizontal plane, then by making the volume of the groove sections larger as the angle of inclination increases, it is possible to hold a larger amount of cleaning liquid to take account of the amount of cleaning liquid which falls off due to the inclination, and therefore the amount of cleaning liquid can be made uniform, regardless of the angle of inclination.

Another aspect of the invention is directed to an inkjet head cleaning system comprising: an inkjet head as defined above; a cleaning liquid deposition device which supplies the cleaning liquid to the plurality of nozzle plates and the cleaning liquid holding members of the inkjet head; and a wiping device which wipes the plurality of nozzle plates of the inkjet head.

According to this aspect of the present invention, since a cleaning liquid holding device which holds cleaning liquid is provided in the inkjet head, then the inkjet head can be used suitably in an inkjet head cleaning system by combination with a wiping device.

Desirably, the wiping device includes a first cleaning member for wiping the plurality of nozzle plates, and a second cleaning member for wiping only the cleaning liquid holding members.

According to this aspect of the present invention, since cleaning liquid can be held by the cleaning liquid holding member, then there is a possibility of cleaning liquid remaining on the cleaning liquid holding member even after the nozzle surface has been wiped with the first cleaning member. By wiping the cleaning liquid holding member only with the second cleaning member, it is possible completely to wipe away the cleaning liquid remaining on the cleaning liquid holding member, and therefore the occurrence of problems, such as cleaning liquid dripping down onto the recording medium and the conveyance drum, can be prevented.

Another aspect of the invention is directed to a maintenance method of an inkjet head, comprising the steps of: moving an inkjet head having a nozzle surface formed by a nozzle plate and a cleaning liquid holding member; depositing cleaning liquid on the nozzle surface of the inkjet head; causing the cleaning liquid to be held on the cleaning liquid holding member of the inkjet head; and wiping the nozzle plate while causing the cleaning liquid held on the cleaning liquid holding member to be transferred by a wiping member.

According to this aspect of the present invention, since a cleaning liquid holding step of holding cleaning liquid in the cleaning liquid holding members of the inkjet head is provided, then in the subsequent wiping step, the nozzle plates can be wiped while causing the cleaning liquid held by the cleaning liquid holding members to propagate by the wiping member, and therefore it is possible to prevent the nozzle surface from being wiped in a state where no cleaning liquid is present, and hence deterioration of the hydrophobic properties of the nozzle plates can be prevented.

Desirably, the maintenance method of an inkjet head further comprises the step of wiping only the cleaning liquid holding member, after wiping the nozzle plate.

According to this aspect of the present invention, a holding member wiping step of wiping only the cleaning liquid holding members is provided after the wiping step, and therefore it is possible to wipe away cleaning liquid remaining on the cleaning liquid holding members.

According to an inkjet head, an inkjet head cleaning system and a maintenance method of an inkjet head according to the present invention, since holding members which hold cleaning liquid are provided substantially in parallel with the direction of arrangement of the nozzle plates of the inkjet head, then it is possible to cause cleaning liquid to propagate from the holding members to the wiping member when cleaning the nozzle plates, and therefore, it is possible to prevent the nozzle surface from being wiped in a state where no cleaning liquid is present, and hence deterioration of the hydrophobic film on the nozzle surface can be prevented.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Composition of Image Recording Unit of Inkjet Recording Apparatus

Figure 1:
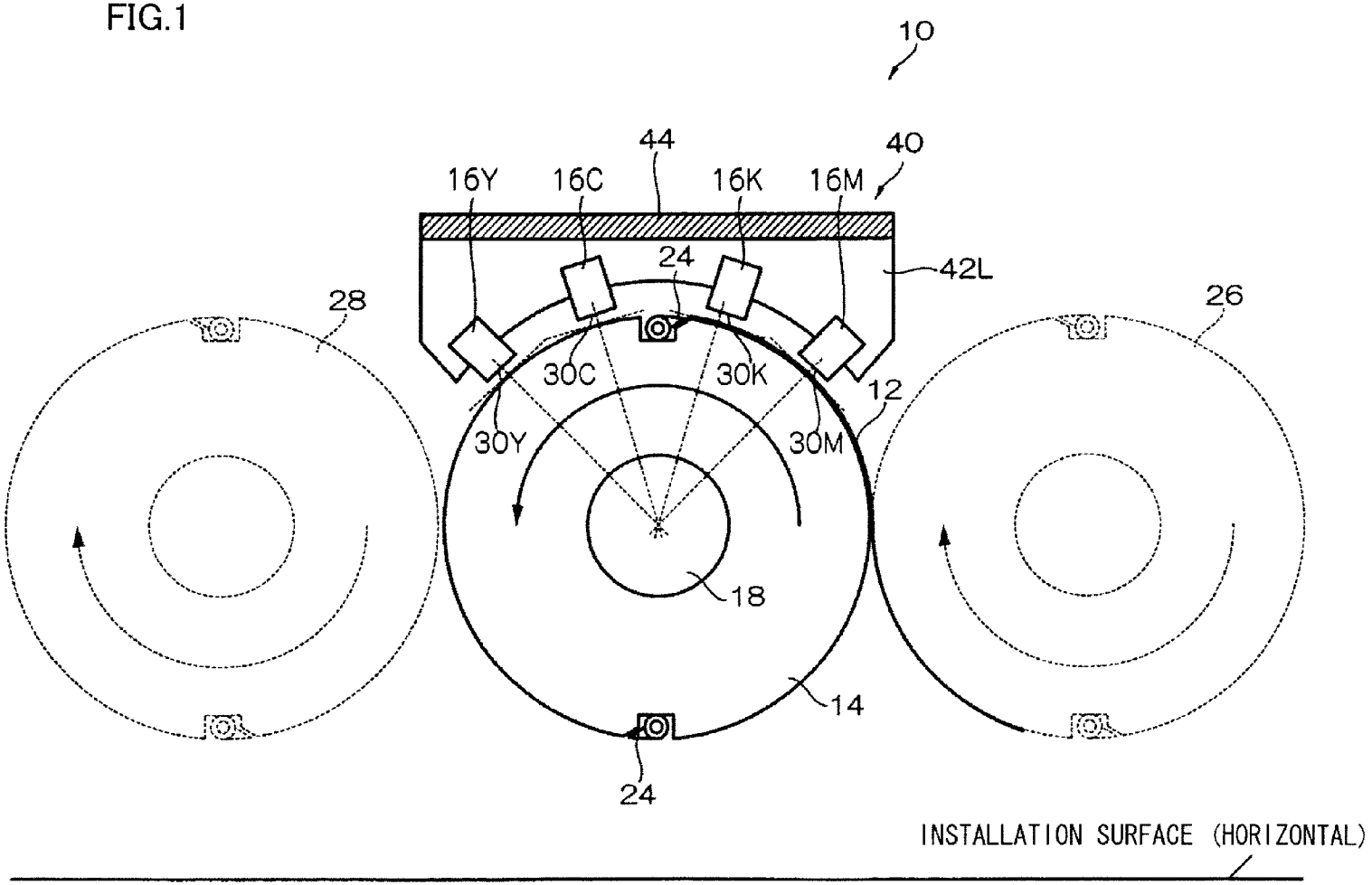
FIG. 1 is a side view diagram showing the general composition of an image recording unit of an inkjet recording apparatus.

FIG. 1 is a side view diagram showing the general composition of an image recording unit of an inkjet recording apparatus.

As shown in FIG. 1, in the image recording unit 10 of an inkjet recording apparatus according to the present embodiment, a recording medium (cut sheet paper) 12 is conveyed by means of an image recording drum 14. Droplets of inks of respective colors of cyan (C), magenta (M), yellow (Y), black (K) are ejected from the inkjet heads (liquid ejection heads) 16C, 16M, 16Y, 16K which are arranged about the periphery of the image recording drum 14, whereby a color image is recorded on the surface of the recording medium 12.

Figure 2:
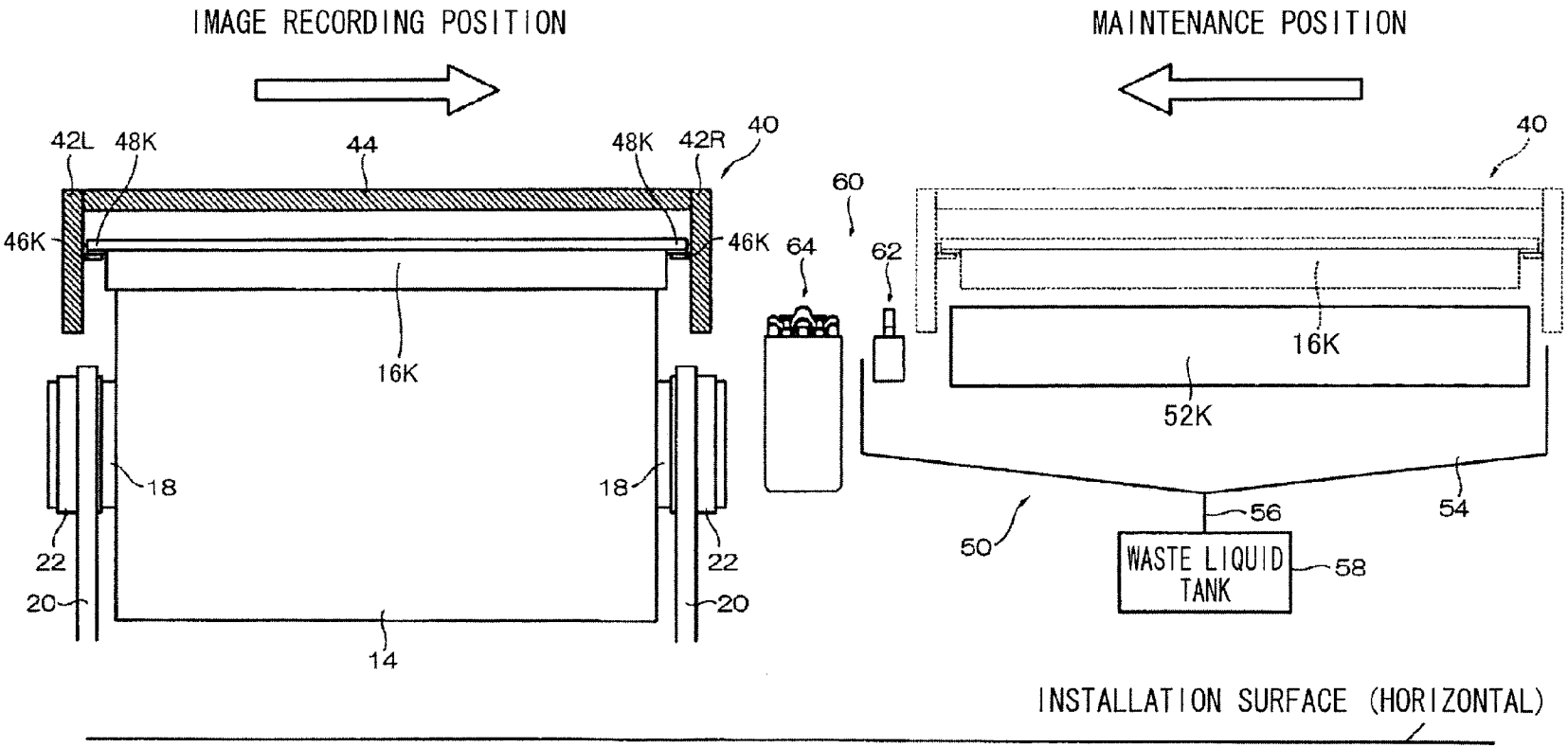
FIG. 2 is a front view diagram of an image recording unit of an inkjet recording apparatus.

The image recording drum 14 is provided rotatably by means of the respective end portions of a rotational axle 18 of the image recording drum 14 being supported on a pair of bearings 22 (see FIG. 2). The pair of bearings 22 are provided on a main frame 20 of the inkjet recording apparatus, and due to both the end portions of the rotational axle 18 being supported on this pair of bearings 22, the image recording drum 14 is installed horizontally (the rotational axle 18 is installed in parallel with the horizontal installation surface).

A motor is coupled via a rotation transmission mechanism (not illustrated) to the rotational axis 18 of the image recording drum 14. The image recording drum 14 is driven by the motor to rotate.

Furthermore, grippers 24 which grip the front end portion of the recording medium 12 are provided on the circumferential surface of the image recording drum 14 (in the present example, at two locations on the outer circumferential surface thereof). The leading end portion of the recording medium 12 is gripped by a gripper 24 and thereby held on the outer circumferential surface of the image recording drum 14.

Furthermore, a suction holding mechanism which is not illustrated (for example, an electrostatic suction or vacuum suction mechanism) is provided in the image recording drum 14. The rear surface portion of the recording medium 12 which is wrapped about the outer circumferential surface of the image recording drum 14 and the front end portion of which is gripped by the gripper 24 is suctioned by the suction holding mechanism and thereby the recording medium 12 is held on the outer circumferential surface of the image recording drum 14.

In the inkjet recording apparatus according to the present embodiment, the recording medium 12 is transferred to the image recording drum 14 through a conveyance drum 26 from the previous step. The conveyance drum 26 is disposed in parallel with the image recording drum 14 and transfers the recording medium 12 onto the image recording drum 14 in a synchronized fashion.

Furthermore, the recording medium 12 after the image recording is transferred to the subsequent step through a conveyance drum 28. The conveyance drum 28 is disposed in parallel with the image recording drum 14 and receives the recording medium 12 from the image recording drum 14 in a synchronized fashion.

The four inkjet heads 16M, 16K, 16C, 16Y are configured by line heads having widths corresponding to the width of a medium, and are arranged radially, at a uniform interval apart, on a concentric circle of which the rotating shaft 18 of the image recording drum 14 is the center.

In the present embodiment, the four inkjet heads 16M, 16K, 16C, 16Y are arranged in left/right symmetry about the image formation drum 14. In other words, the magenta line head 16M and the yellow line head 16Y are disposed in left/right symmetry with respect to a vertical line which passes through the center of the image recording drum 14, and the black line head 16K and the cyan line head 16C are also disposed in left/right symmetry with respect to the same vertical line.

Nozzle surfaces 30M, 30K, 30C, 30Y which are respectively formed at lower ends of the inkjet heads 16M, 16K, 16C, 16Y disposed as described above, are positioned so as to face the outer circumferential surface of the image recording drum 14, and the nozzle surfaces 30M, 30K, 30C, 30Y are disposed at a prescribed height position from the outer circumferential surface of the image recording drum 14 (a uniform gap is formed between the outer circumferential surface of the image recording drum 14 and each of the nozzle surfaces 30M, 30K, 30C, 30Y). Furthermore, inkjet nozzles are formed in the nozzle surfaces 30M, 30K, 30C, 30Y, and are arranged in rows perpendicular to the conveyance direction of the recording medium 12.

Ink droplets are ejected perpendicularly onto the outer circumferential surface of the image recording drum 14 from the nozzles which are formed on the nozzle surfaces 30M, 30K, 30C, 30Y of the inkjet heads 16M, 16K, 16C, 16Y disposed in this fashion.

Figure 3:
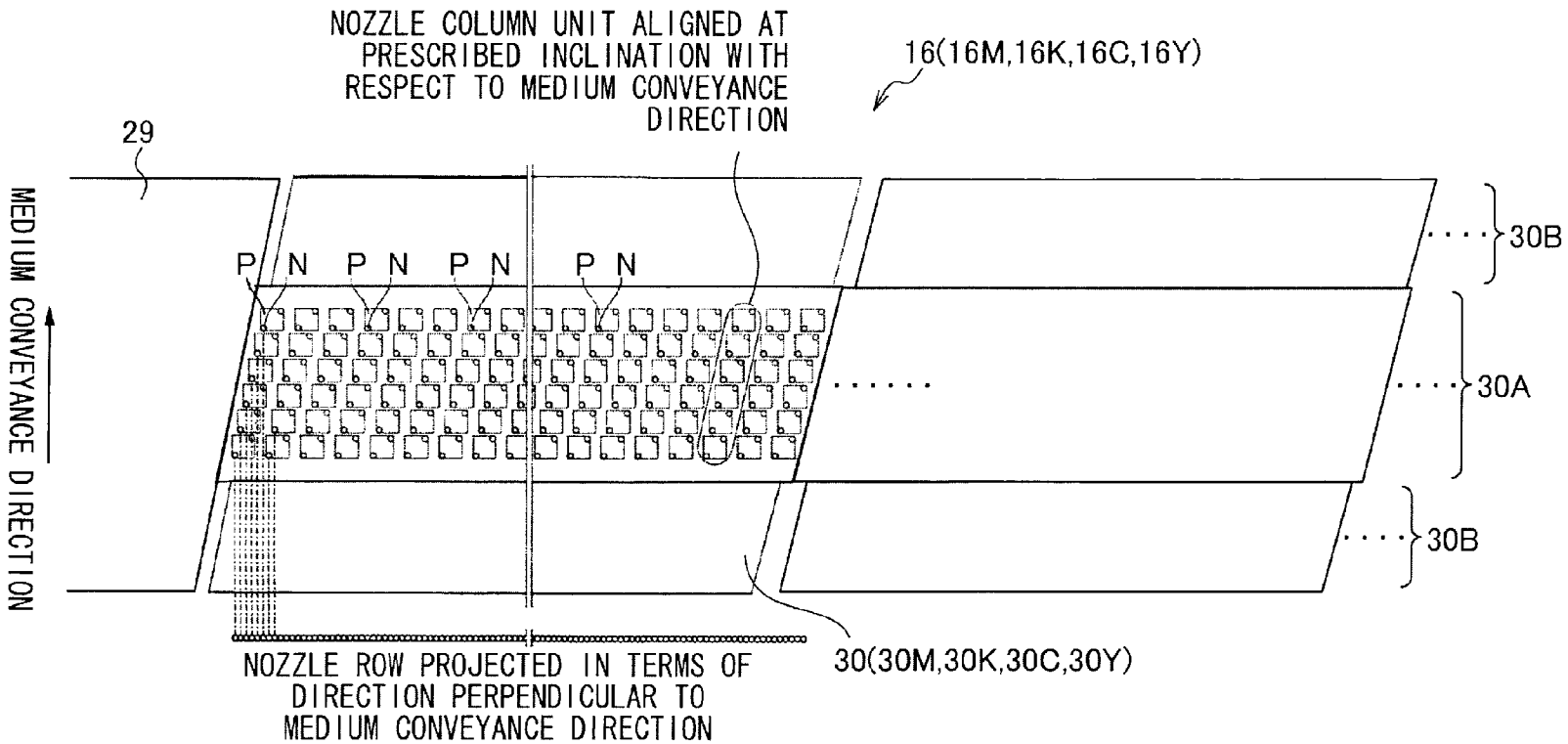
FIG. 3 is a plan view perspective diagram of a nozzle surface of an inkjet head.

FIG. 3 is a plan view perspective diagram of a nozzle surface of an inkjet head.

The inkjet heads 16M, 16K, 16C, 16Y have the same composition, and therefore the composition of one inkjet head 16 and the nozzle surface 30 (30M, 30K, 30C, 30Y) thereof is described here.

As shown in FIG. 3, the nozzle surface 30 is substantially parallelogram-shaped and includes a nozzle plate 30A in which a plurality of nozzles N are formed in the width direction (the recording medium conveyance direction), and on either side of the nozzle plate 30A, wing sections 30B made of plastic (LCP, epoxy resin, or the like) for arranging the independent ink jet head module including the nozzle plate 30A in alignment with the width direction of the recording medium. Furthermore, a plurality of nozzle plates 30A are arranged so as to correspond to the width of the recording medium.

The nozzle plate 30A is a region where nozzles N are formed and a prescribed lyophobic treatment is provided on the surface of this region (the plate is coated with a lyophobic film). The nozzle plate 30A is made from a substantially parallelogram-shaped Si substrate, and the nozzles N are opened therein by wet etching, or the like.

Here, as shown in FIG. 3, the inkjet head 16 according to the present embodiment is configured by a so-called matrix head and nozzles N are arranged in a two-dimensional matrix configuration in the nozzle plate 30A. More specifically, nozzle rows are formed by arranging a plurality of nozzles N at a uniform pitch in a direction inclined by a prescribed angle with respect to the direction of conveyance of the recording medium 12, and furthermore a plurality of the nozzle rows are arranged at uniform pitch in the direction (the lengthwise direction of the head) which is perpendicular to the conveyance direction of the recording medium 12. By adopting an arrangement of this kind for the nozzles, it is possible to reduce the effective pitch between the nozzles N as projected in terms of the lengthwise direction of the head (namely, a direction perpendicular to the conveyance direction of the recording medium 12), and therefore a high-density configuration of the nozzles N can be achieved.

In a matrix head, the effective nozzle row is a row of nozzles projected to the lengthwise direction of the head.

Furthermore, the inkjet head 16 according to the present embodiment ejects droplets of ink from nozzles N by a so-called piezo jet system. More specifically, the nozzles N formed in the nozzle surface 30 are respectively connected to pressure chambers P, and the volume of the pressure chambers P are compressed thereby causing droplets to be ejected from the nozzles N, by causing the side walls of the pressure chambers P to vibrate by means of piezo elements.

The ink ejection method is not limited to this and may also adopt a composition which performs ejection by employing a thermal method or using an electrostatic actuator.

In the inkjet head 16 according to the present embodiment, lyophobic treatment is applied only to the nozzle plate 30A. A hydrophilic treatment is applied to the wing sections 30B, and when liquid is deposited on the wing sections, this liquid is held in the wing sections 30B. The contact angle of water with respect to the nozzle plate 30A can be set to 100° or above, for example, and the contact angle of water with respect to the wing sections 30B can be set to approximately 60°, for example. Moreover, a desirable composition is one where end caps 29 which form end sections in the arrangement direction of the nozzle surfaces are also formed to have lyophilic properties so as to readily hold cleaning liquid, similarly to the wing sections 30B.

Figure 4B:
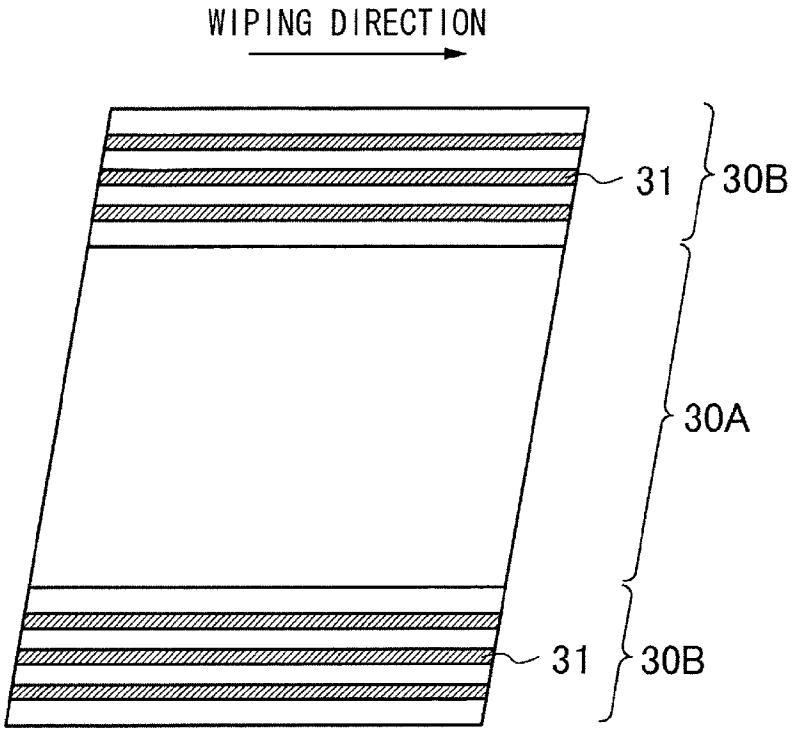
FIG. 4A is a side view diagram of an inkjet head and FIG. 4B is a plan view diagram of a nozzle surface.
Figure 4A:
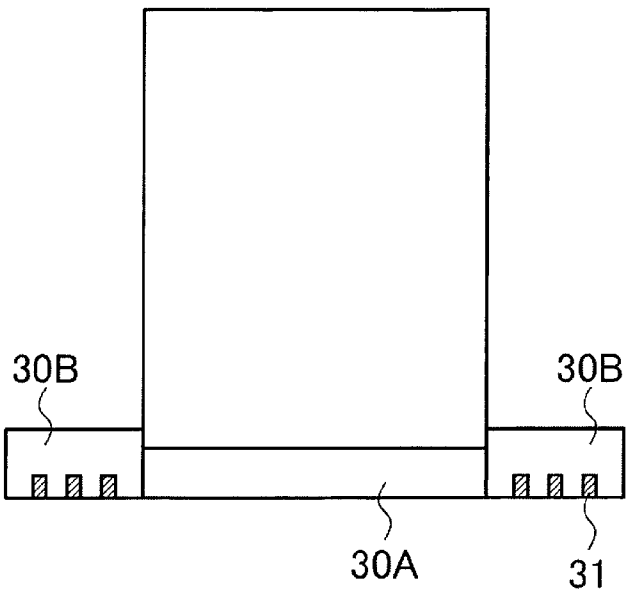

FIG. 4A is a side view diagram showing a composition of the wing sections 30B in the inkjet head 16, and FIG. 4B is a plan diagram of same. In FIGS. 4A and 4B, the nozzles N are not depicted. The nozzle surface 30 of the inkjet head according to the present embodiment of the present invention includes a nozzle plate 30A having the nozzles and wing sections 30B, and the wing sections 30B have a lyophilic film. By forming each of the wing sections 30B with a lyophilic film, it is possible to cause cleaning liquid to adhere to the wing sections 30B and to hold the cleaning liquid on the wing sections 30B, when the cleaning liquid is deposited on the nozzle surface 30. Consequently, when the nozzle plate 30A is wiped subsequently by a wiping web, the cleaning liquid held on the wing sections 30B is transferred to the wiping web, and the nozzle plate 30A can be wiped in a state where the wiping web is impregnated with cleaning liquid. By this means, it is possible to prevent deterioration of the lyophobic film which coats the nozzle plate 30A. Since a lyophobic film is formed on the nozzle plate 30A, then even if cleaning liquid is deposited on the nozzle plate 30A, there is a possibility that the cleaning liquid will run off due to the lyophobic properties of the nozzle plate 30A. By making the wing sections 30B hydrophilic, it is possible to transmit the cleaning liquid held on the wing sections 30B, to the nozzle plate via the wiping web, and therefore the nozzle plate 30A can be wiped in a wet state.

By making the wing sections 30B hydrophilic, it is possible to hold the cleaning liquid, but as shown in FIGS. 4A and 4B, desirably groove sections 31 are provided. By providing groove sections 31, it is possible to collect cleaning liquid in the groove sections 31, and therefore the amount of cleaning liquid which is transmitted to the wiping web during wiping can be increased. Since the concentration of the ink on the nozzle plate 30A can be lowered by increasing the amount of cleaning liquid, then it is possible to improve the durability of the hydrophobic film.

In FIGS. 4A and 4B, the groove sections 31 are formed in parallel with the direction of arrangement of the nozzle plates 30A. More specifically, the groove sections 31 are formed in parallel with the direction of wiping of the wiping web. By forming the grooves in parallel with the wiping direction, it is possible to reduce the resistance during wiping. By this means, it is possible to avoid the possibility of the wiping member catching on the groove sections 31 or causing the inkjet head to vibrate due to resistance. Furthermore, it is also possible to supply the cleaning liquid continuously in a stable manner at all times, by transmission along the wiper.

Figure 5A:
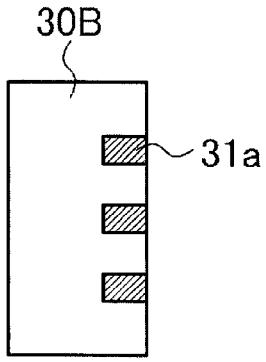
FIGS. 5A to 5D are cross-sectional diagrams showing shapes of groove sections.
Figure 5C:
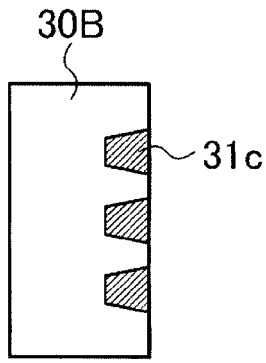
Figure 5B:
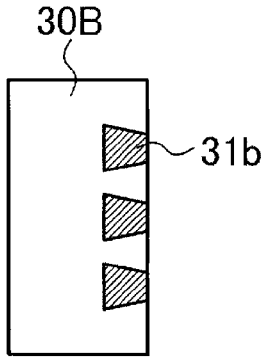

FIGS. 5A to 5D illustrates examples showing shapes of the groove sections 31 of a wing section 30B. FIG. 5A shows square-shaped groove sections 31*a*. FIG. 5B shows groove sections 31*b* which have an inverse tapered shape. By forming the groove sections 31*b* with an inverse taper, it is possible to prevent the cleaning liquid from escaping from the groove sections 31*b*, after the cleaning liquid has been held in the groove sections 31*b*, until the wiping web makes contact with the cleaning liquid held in the grooves. In other words, it is possible to improve the cleaning liquid holding properties.

Figure 5D:
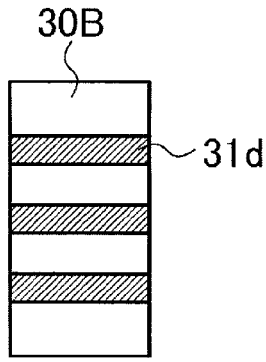

FIG. 5C shows groove sections 31*c* which have a tapered shape. By forming the groove sections with a tapered shape, it is possible to facilitate the entry of cleaning liquid into the groove sections 31*c*, and the amount of cleaning liquid that can be held by the grooves can be increased. Furthermore, the cleaning liquid also becomes more readily absorbed by the wiping web, when the groove sections are wiped by the wiping web. FIG. 5D shows a case where groove sections 31*d* are formed so as to pass through the wing section 30B. By forming the groove sections 31*d* to pass through the wing section 30B, it is possible to prevent blockages caused by ink solidifying in the ends of the groove sections.

Figure 6:
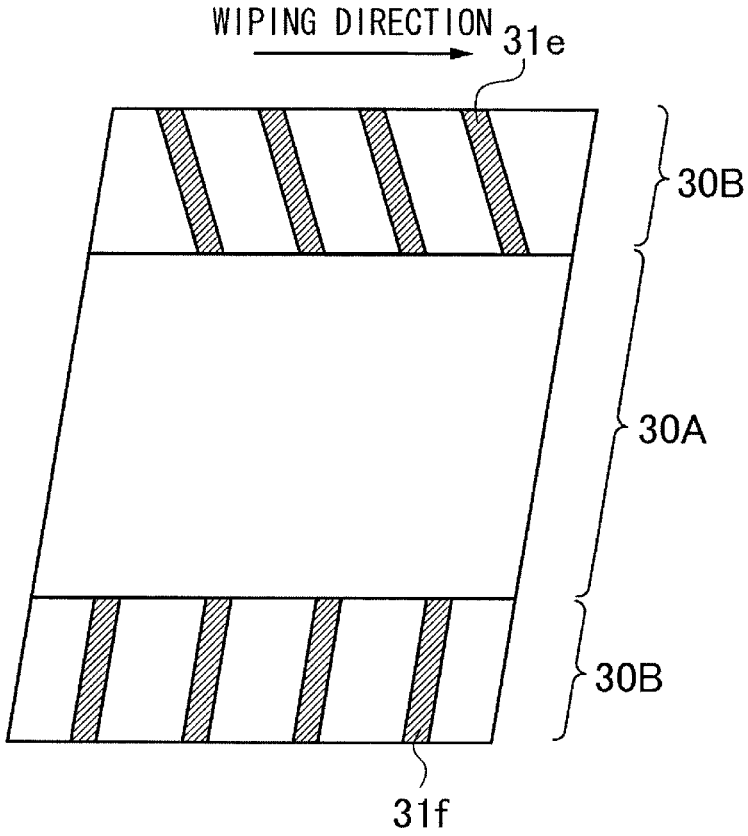
FIG. 6 is a plan diagram of a nozzle surface showing a further example of an inkjet head.

FIG. 6 shows a further mode of the direction of groove sections formed in a wing section 30B. The groove sections in the wing sections 30B shown in FIG. 6 are composed in such a manner that the groove sections 31*f* on one of the two sides of the nozzle plate 30A have a guide structure and face towards the nozzle plate 30A. By this means, it is possible to convey the cleaning liquid efficiently to the nozzle plate 30A, thus lowering the ink concentration and improving the durability of the hydrophobic film. Furthermore, by adopting a guide structure for the groove sections 31*e* on one side while setting the groove sections 31*f* on the other side to being in a different direction, it is possible to convey the cleaning liquid efficiently to the nozzle plate 30A.

Figure 7A:
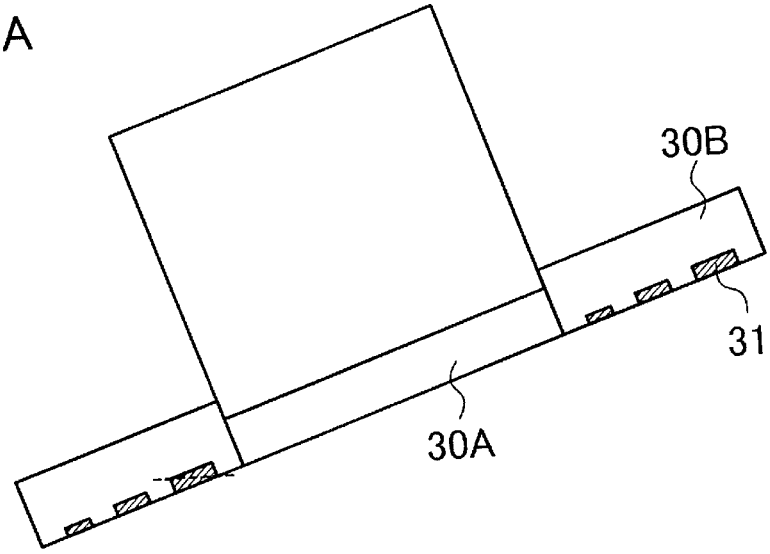
FIGS. 7A and 7B are cross-sectional diagrams illustrating groove sections in inkjet heads having different inclinations.
Figure 7B:
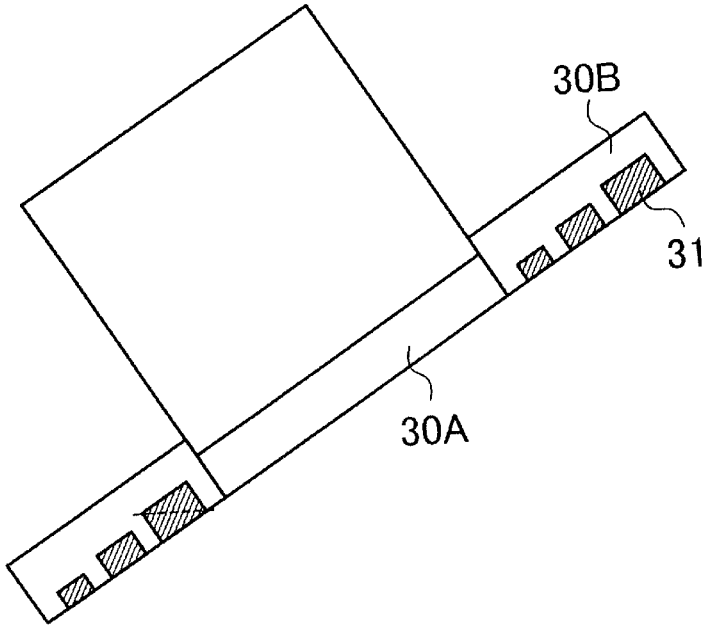

As one example of a liquid ejection apparatus, as described above, in the present embodiment of the present invention, the nozzle surface 30 is provided in an inclined fashion with respect to the horizontal plane. Furthermore, as shown in FIG. 1, the angle of inclination of the nozzle surface varies depending on the color. If the angle of inclination varies, then the amount of cleaning liquid held by the wing sections 30B also changes. Consequently, as FIGS. 7A and 7B show, it is desirable to make the amount of cleaning liquid held by the grooves uniform, by altering the depth, size, number, and the like, of the groove sections in accordance with the angle of inclination of the nozzles (the installation angle). For example, FIG. 7A shows an example of patterns of groove sections 31 in a case where the inclination is small, as in the inkjet heads 16K and 16C shown in FIG. 1. Furthermore, FIG. 7B shows an example of patterns of groove sections 31 in a case where the inclination is large, as in the inkjet heads 16M and 16Y shown in FIG. 1. As FIGS. 7A and 7B show, if the inclination of the inkjet head 16 is large, then the amount of cleaning liquid held is increased by making the groove sections 31 deeper or by enlarging the openings of the groove sections 31, or the like, to increase the volume of the groove sections 31. If the inclination is low, then the amount of cleaning liquid held is decreased by making the groove sections 31 shallower or by making the openings of the groove sections 31 smaller, or the like, to reduce the volume of the groove sections 31. Since the cleaning liquid is liable to flow as the inclination becomes greater, it is also possible to adjust the amount of cleaning liquid applied to the nozzle plate 30A by altering the shape of the groove sections 31 and thereby adjusting the amount of cleaning liquid held in the wing sections 30B. In FIGS. 7A and 7B, the amount of cleaning liquid held is adjusted by altering the volume, but it is also possible to change the amount of cleaning liquid held, by increasing the number of grooves.

Furthermore, in FIGS. 7A and 7B, the volume decreases from the grooves formed at a high position with respect to the horizontal plane of the wing section 30B toward grooves formed at a low position, but by adopting a composition of this kind, it is possible to supply cleaning liquid of a uniform volume to the nozzle plate 30A. Moreover, by enlarging the volume of the groove sections from the nozzle plate 30A side of the wing section 30B, it is possible to increase the supply volume to the nozzle plate 30A. The shape, depth, width, number, and the like, of the groove sections can be devised appropriately in accordance with the amount of cleaning liquid supplied to the nozzle surface, and the like.

The image recording unit 10 has the composition described above. In this image recording unit 10, the recording medium 12 is received onto the image recording drum 14 from a previous step via the conveyance drum 26, and is conveyed in rotation while being held by suction on the circumferential surface of the image recording drum 14. The recording medium 12 passes below the inkjet heads 16M, 16K, 16C, 16Y during this conveyance and ink droplets are ejected from the inkjet heads 16M, 16K, 16C, 16Y onto the recording surface of the medium as the medium passes, thereby forming a color image on the recording surface. The recording medium 12 having the image recorded thereon is transferred from the image recording drum 14 to the conveyance drum 28 and is conveyed to a subsequent step.

In the image recording unit 10 having the composition described above, the inkjet heads 16M, 16K, 16C, 16Y are installed on a head supporting frame 40 and are arranged around the image recording drum 14 as shown in FIG. 2.

The head supporting frame 40 is composed by a pair of side plates 42L and 42R which are provided perpendicularly with respect to the rotating shaft 18 of the image recording drum 14, and a linking frame 44 which links the pair of side plates 42L and 42R together at the upper end portions thereof.

The pair of side plates 42L and 42R are formed in a plate shape, and are disposed so as to be mutually opposing via the image recording drum 14. Installation sections 46M, 46K, 46C, 46Y for installing the respective inkjet heads 16M, 16K, 16C, 16Y are provided on the inner side of the pair of side plates 42L and 42R (only the installation sections 46K are depicted in FIG. 2 for convenience).

The installation sections 46M, 46K, 46C, 46Y are disposed in a radiating fashion at a uniform spacing apart on a concentric circle with the center of the rotating shaft 18 of the image recording drum 14. The inkjet heads 16M, 16K, 16C, 16Y are installed on the head supporting frame 40 by fixing attachment sections 48M, 48K, 48C, 48Y which are formed on the respective ends of the heads (only the attachment sections 48K are depicted in FIG. 2 for convenience) onto the installation sections 46M, 46K, 46C, 46Y. By installing the inkjet heads 16M, 16K, 16C, 16Y on this head supporting frame 40, the heads are disposed in radiating fashion at a uniform spacing apart on a concentric circle with the center of the rotating shaft 18 of the image recording drum 14.

The head supporting frame 40 is provided slidably in a direction parallel to the rotating shaft 18 of the image recording drum 14 by being guided by a guide rail which is not illustrated. This head supporting frame 40 is moved between an "image recording position" indicated by the solid lines in FIG. 2 and a "maintenance position" indicated by the dotted lines in FIG. 2, by being driven by a linear drive mechanism (not illustrated) such as, for example, a screw feed mechanism.

When the head supporting frame 40 is disposed in the image recording position, the inkjet heads 16M, 16K, 16C, 16Y are disposed about the periphery of the image recording drum 14 and assume a state capable of image recording.

The maintenance position is set to a position where the inkjet heads 16M, 16K, 16C, 16Y are withdrawn from the image recording drum 14. A moisturizing unit 50 for moisturizing the inkjet heads 16M, 16K, 16C, 16Y is provided in this maintenance position.

The moisturizing unit 50 includes caps 52M, 52K, 52C, 52Y (in FIG. 2, only the cap 52K is depicted for convenience) which cover the nozzle surfaces of the respective inkjet heads 16M, 16K, 16C, 16Y. When the apparatus is halted for a long period of time, or the like, the nozzle surface is covered with the caps 52M, 52K, 52C, 52Y. By this means, ejection failure due to drying is prevented.

A pressurization and suctioning mechanism (not illustrated) is provided with the caps 52M, 52K, 52C, 52Y, in such a manner that the interior of the nozzles can be pressurized and suctioned.

Furthermore, a cleaning liquid supply mechanism (not illustrated) is provided with the caps 52M, 52K, 52C, 52Y, in such a manner that cleaning liquid can be supplied to the interior of the caps.

A waste liquid tray 54 is disposed in a position below the caps 52M, 52K, 52C, 52Y. The cleaning liquid supplied to the caps 52M, 52K, 52C, 52Y is discarded into the waste liquid tray 54 and is recovered into a waste liquid tank 58 via a waste liquid recovery pipe 56.

A nozzle surface cleaning apparatus 60 for cleaning the nozzle surfaces 30M, 30K, 30C, 30Y of the inkjet heads 16M, 16K, 16C, 16Y is provided between the image recording position and the maintenance position. The nozzle surfaces 30M, 30K, 30C, 30Y of the inkjet heads 16M, 16K, 16C, 16Y are cleaned by the nozzle surface cleaning apparatus 60 while the inkjet heads are moved from the maintenance position to the image recording position or moved from the image recording position to the maintenance position.

Below, the composition of the nozzle surface cleaning apparatus 60 will be described.

Composition of Nozzle Surface Cleaning Apparatus

As shown in FIG. 2, the nozzle surface cleaning apparatus 60 includes a cleaning liquid deposition apparatus (or a cleaning liquid ejection unit) 62 and a nozzle surface wiping device 64.

The cleaning liquid deposition apparatus 62 applies the cleaning liquid to the nozzle surfaces 30M, 30K, 30C, 30Y of the inkjet heads 16M, 16K, 16C, 16Y which are moved from the maintenance position toward the image recording position.

The nozzle surface wiping device 64 wipes the nozzle surfaces 30M, 30K, 30C, 30Y of the inkjet heads 16M, 16K, 16C, 16Y on which cleaning liquid has been deposited, by abutting and pressing wiping webs against the nozzle surfaces 30M, 30K, 30C, 30Y.

The cleaning liquid deposition apparatus 62 and the nozzle surface wiping device 64 are disposed in the movement path of the head supporting frame 40. In this case, the cleaning liquid deposition apparatus 62 is disposed to the maintenance position side with respect to the nozzle surface wiping device 64. By this means, the nozzle surfaces 30M, 30K, 30C, 30Y of the inkjet heads 16M, 16K, 16C, 16Y can be wiped by the wiping webs after deposition of the cleaning liquid, while the inkjet heads 16M, 16K, 16C, 16Y are moved from the maintenance position to the image recording position.

Composition of Cleaning Liquid Deposition Apparatus

Figure 8:
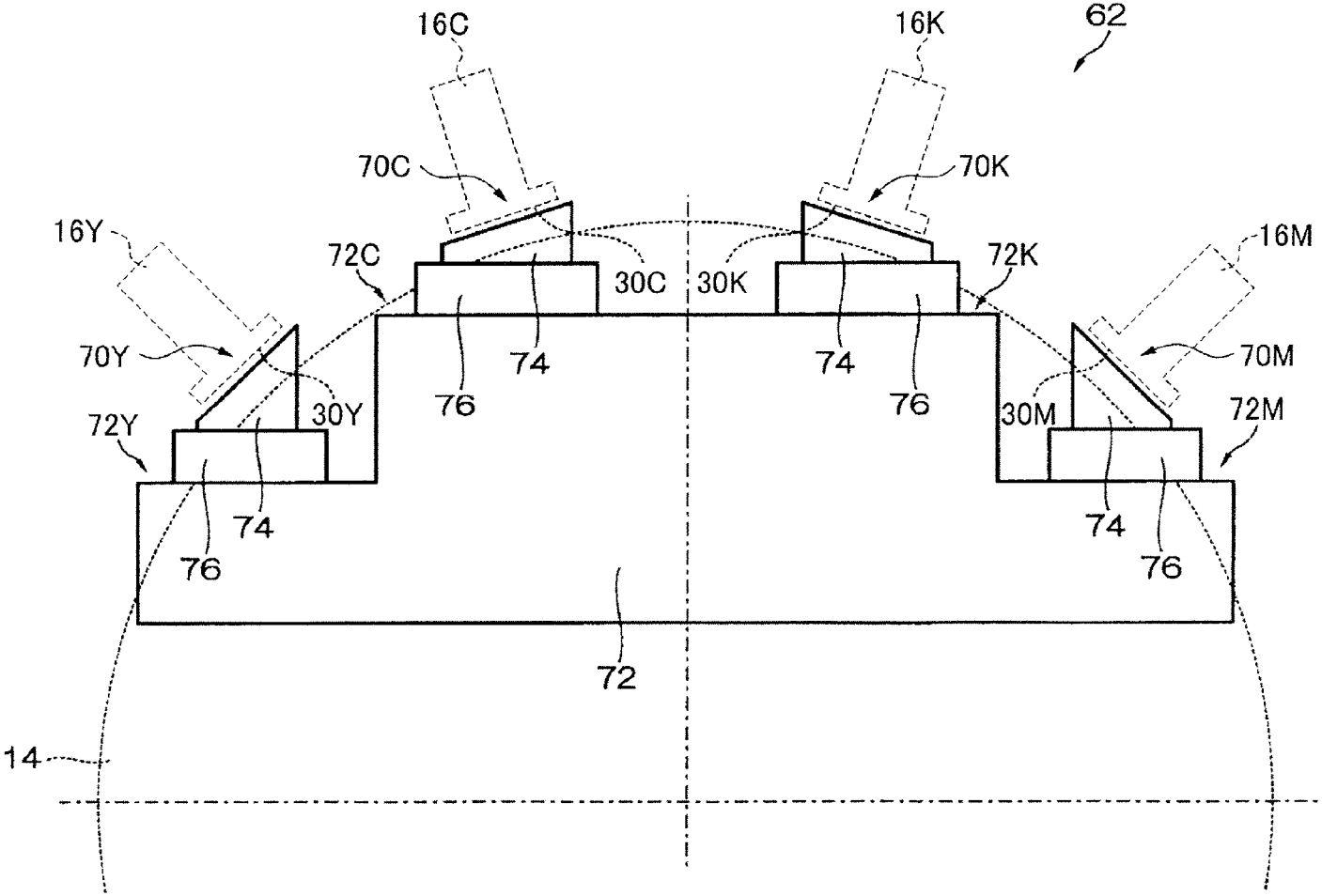
FIG. 8 is a side view diagram showing a cleaning liquid deposition apparatus viewed from the maintenance position.

FIG. 8 is a side view diagram showing a cleaning liquid deposition apparatus viewed from the maintenance position side.

The cleaning liquid deposition apparatus 62 is constituted by cleaning liquid deposition units 70M, 70K, 70C, 70Y which are provided to correspond to the inkjet heads 16M, 16K, 16C, 16Y respectively, and a base 72 on which the cleaning liquid deposition units 70M, 70K, 70C, 70Y are mounted. The cleaning liquid deposition apparatus 62 is disposed in the inner side of the waste liquid tray 54 which is provided in the moisturizing unit 50 (see FIG. 2).

<Composition of Base>

The base 72 is provided horizontally and is provided so as to be raisable and lowerable by an elevator apparatus, which is not illustrated. Cleaning liquid deposition unit attachment sections 72M, 72K, 72C, 72Y are formed in the upper surface portion of the base 72. The cleaning liquid deposition units 70M, 70K, 70C, 70Y are fixed to the cleaning liquid deposition unit attachment sections 72M, 72K, 72C, 72Y formed in the base 72, by bolts, or the like, and are thereby installed in prescribed positions. By installing the cleaning liquid deposition units 70M, 70K, 70C, 70Y on the base 72, the cleaning liquid deposition units 70M, 70K, 70C, 70Y are arranged in the movement path of the corresponding inkjet heads 16M, 16K, 16C, 16Y (namely, in the movement path from the image recording position to the maintenance position).

Composition of Cleaning Liquid Deposition Unit

Next, the composition of the cleaning liquid deposition units 70M, 70K, 70C, 70Y will be described.

The cleaning liquid deposition units 70M, 70K, 70C, 70Y each have the same basic composition and therefore the composition of a cleaning liquid deposition unit 70 will be described here.

Figure 9:
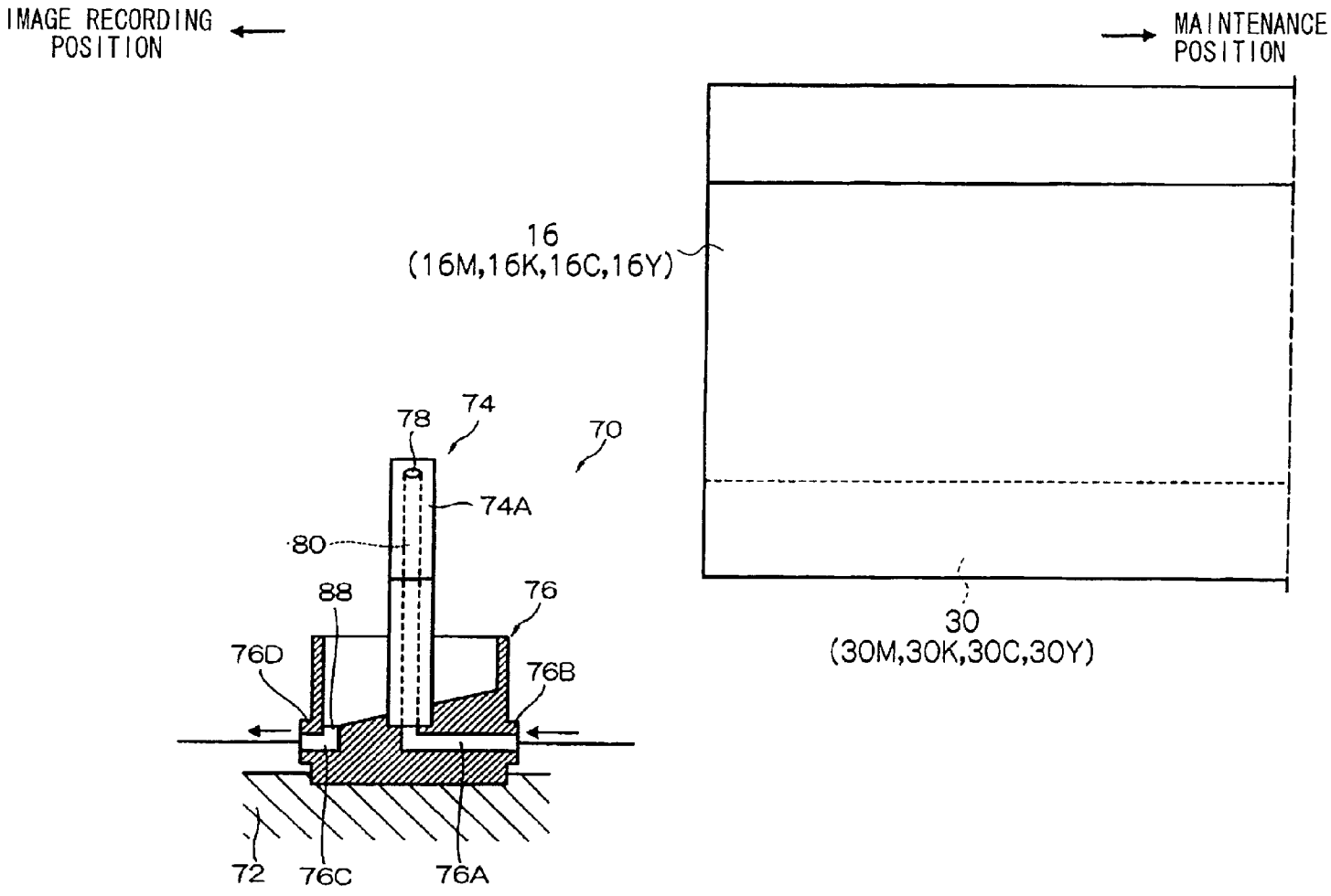
FIG. 9 is a front view diagram of a cleaning liquid deposition unit.
Figure 10:
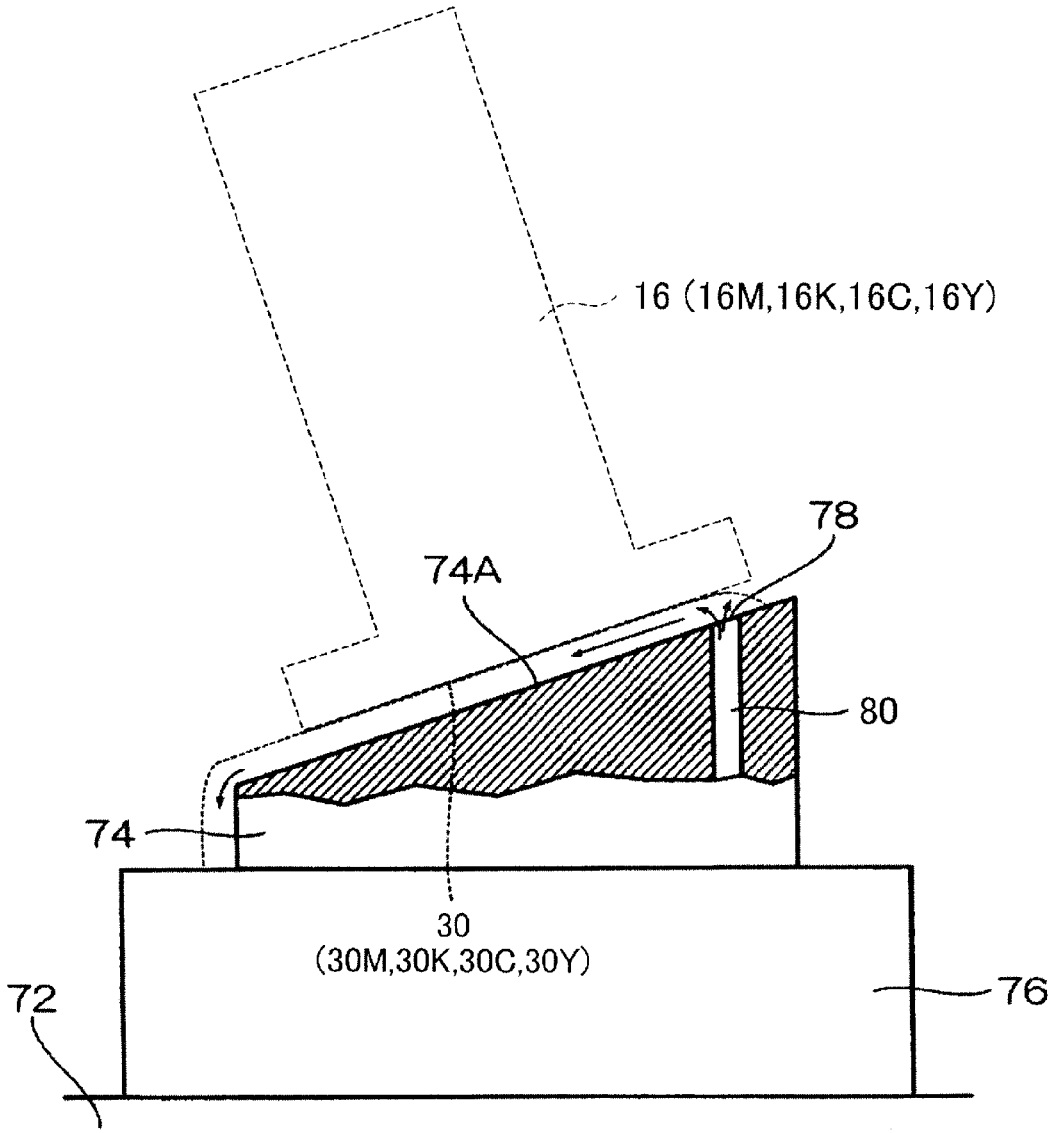
FIG. 10 is a front view diagram of a cleaning liquid deposition unit.

FIG. 9 and FIG. 10 are respectively a front view diagram and a side view diagram of a cleaning liquid deposition unit.

As shown in FIG. 9 and FIG. 10, the cleaning liquid deposition unit 70 includes a cleaning liquid deposition head 74 which deposits cleaning liquid onto the nozzle surface 30, and a cleaning liquid recovery tray 76 which recovers cleaning liquid that has dropped down from the nozzle surface 30.

The cleaning liquid recovery tray 76 is formed in the shape of a square box with an upper portion thereof open. The cleaning liquid deposition head 74 is erected vertically inside the cleaning liquid recovery tray 76.

The cleaning liquid deposition head 74 is formed in a quadrilateral block shape with an inclined upper surface, and has an inclined cleaning liquid holding surface 74A, in the upper portion thereof. The cleaning liquid holding surface 74A is formed at the same angle of inclination of the nozzle surface 30 of the head that is to be cleaned, and is formed to have a slightly greater width than the width of the nozzle surface 30 (the width in the medium conveyance direction).

A cleaning liquid emission port 78 is formed in the vicinity of the upper part of the cleaning liquid holding surface 74A, and cleaning liquid flows out from this cleaning liquid emission port 78. The cleaning liquid which has flowed out from the cleaning liquid emission port 78 flows down over the cleaning liquid holding surface 74A. By this means, a layer (film) of cleaning liquid is formed on the cleaning liquid holding surface 74A. Cleaning liquid is applied to the nozzle surface 30 of the inkjet head 16 by bringing the nozzle surface 30 into contact with the layer of cleaning liquid formed on the cleaning liquid holding surface 74A.

A supply flow channel 80 connected to the cleaning liquid emission port 78 is formed inside the cleaning liquid deposition head 74. This supply flow channel 80 is connected to a connection flow channel 76A formed in the cleaning liquid recovery tray 76 and the connection flow channel 76A is connected to a cleaning liquid supply port 76B formed in the cleaning liquid recovery tray 76. When cleaning liquid is supplied to the cleaning liquid supply port 76B in the cleaning liquid deposition head 74, the cleaning liquid flows out from the cleaning liquid emission port 78.

The cleaning liquid is supplied from a cleaning liquid tank (not illustrated). A pipe (not illustrated) connected to this cleaning liquid tank is connected to the cleaning liquid supply port 76B. A cleaning liquid supply pump (not illustrated) and a valve (not illustrated) are provided with this pipe, and by opening the valve and driving the cleaning liquid supply pump, cleaning liquid is supplied from the cleaning liquid tank to the cleaning liquid deposition head 74.

The cleaning liquid recovery tray 76 is formed in the shape of a square box with an upper portion thereof open, as described above. The bottom portion of the cleaning liquid recovery tray 76 is formed with an inclination and a recovery hole 88 is formed in the lower end portion in the direction of inclination. This recovery hole 88 is connected to a cleaning liquid emission port 76D formed in the side face portion of the cleaning liquid recovery tray 76, via a recovery flow channel 76C formed inside the cleaning liquid recovery tray 76.

The cleaning liquid emitted from the cleaning liquid emission port 78 of the cleaning liquid deposition head 74 falls down from the cleaning liquid holding surface 74A and is recovered into the cleaning liquid recovery tray 76. The cleaning liquid recovered by the cleaning liquid recovery tray 76 is guided to the nozzle surface wiping device 64 and is used for flushing waste liquid. This point is described in detail below.

The cleaning liquid deposition units 70 (70M, 70K, 70C, 70Y) are each composed as described above. A cleaning liquid deposition apparatus 62 is composed by installing the cleaning liquid deposition units 70M, 70K, 70C, 70Y on cleaning liquid unit installation sections 72M, 72K, 72C, 72Y formed on the base 72.

The operation of the cleaning liquid deposition apparatus 62 is controlled by a controller, which is not illustrated. The controller controls the driving of the elevator apparatus, and the like, so as to control the cleaning liquid deposition operation by the cleaning liquid deposition apparatus 62.

Furthermore, cleaning liquid having a main component of diethylene monobutyl ether, for example, is used as the cleaning liquid. By applying a cleaning liquid of this type to the nozzle surfaces 30, it is possible to readily dissolve and remove solid fixing matter originating from the ink which has adhered to the nozzle surfaces 30.

Action of Cleaning Liquid Deposition Apparatus

Next, a cleaning liquid deposition operation by the cleaning liquid deposition apparatus 62 having the composition described above will be explained.

The cleaning liquid deposition apparatus 62 deposits cleaning liquid onto the nozzle surfaces 30 (30M, 30K, 30C, 30Y) of the heads while the inkjet heads 16 (16M, 16K, 16C, 16Y) move from the maintenance position to the image recording position. More specifically, the cleaning liquid is deposited as follows.

The whole of the cleaning liquid deposition apparatus 62 is provided in a raisable and lowerable fashion. When not performing cleaning, the cleaning liquid deposition apparatus 62 is disposed in a prescribed standby position. When performing cleaning, the cleaning liquid deposition apparatus 62 is raised by a prescribed amount from the standby position and is moved to a prescribed operating position.

When the cleaning liquid deposition apparatus 62 is moved to the operating position, the cleaning liquid deposition units 70M, 70K, 70C, 70Y are set in prescribed cleaning liquid deposition positions. By this means, it is possible to deposit cleaning liquid onto the nozzle surfaces 30M, 30K, 30C, 30Y of the respective heads, by means of cleaning liquid deposition heads 74 provided in the cleaning liquid deposition units 70M, 70K, 70C, 70Y.

When each of the cleaning liquid deposition units 70M, 70K, 70C, 70Y are set in the prescribed cleaning liquid deposition position, the controller drives the linear drive mechanism and causes the head supporting frame 40 to move at a prescribed speed of movement from the maintenance position towards the image recording position.

On the other hand, the controller also drives the cleaning liquid supply pump in accordance with the timing at which the inkjet heads 16M, 16K, 16C, 16Y arrive at the cleaning liquid deposition heads 74 of the cleaning liquid deposition units 70M, 70K, 70C, 70Y. By this means, cleaning liquid is ejected at a prescribed flow rate from the cleaning liquid emission ports 78 of the cleaning liquid deposition heads 74 provided in the respective cleaning liquid deposition units 70M, 70K, 70C, 70Y. The cleaning liquid ejected from the cleaning liquid emission ports 78 flows down over the cleaning liquid holding surfaces 74A. By this means, a layer (film) of the cleaning liquid is formed on the cleaning liquid holding surfaces 74A.

The nozzle surfaces 30M, 30K, 30C, 30Y of the inkjet heads 16M, 16K, 16C, 16Y which moves to the image recording position contact the layer of cleaning liquid formed on the cleaning liquid holding surface 74A of the cleaning liquid deposition head 74, whereby the cleaning liquid is deposited onto the nozzle surfaces.

An inkjet head of the related art is installed at an inclination following a drum shape, and although mist remaining on nozzles can be cleaned away by applying cleaning liquid to the nozzle surface, since the nozzle plate is formed with a hydrophobic film, then the cleaning liquid does not remain in a deposited state on the nozzle plate. If there is no cleaning liquid on the nozzle plate, then cleaning is performed by drawing ink out from inside the nozzles, and wiping is performed with a relatively high pigment concentration. In particular, when using black ink, since carbon is used as a pigment, the hydrophobic film deteriorates during wiping and there is a possibility of subsequent deviation in terms of the ink ejection direction. According to the present embodiment of the present invention, it is possible to collect cleaning liquid in the wing sections and a web which is impregnated with cleaning liquid is used, thus making it possible to reduce the ink concentration on the nozzle surface and to enhance the durability of the hydrophobic film on the nozzle plate.

Composition of Nozzle Surface Wiping Device

Figure 11:
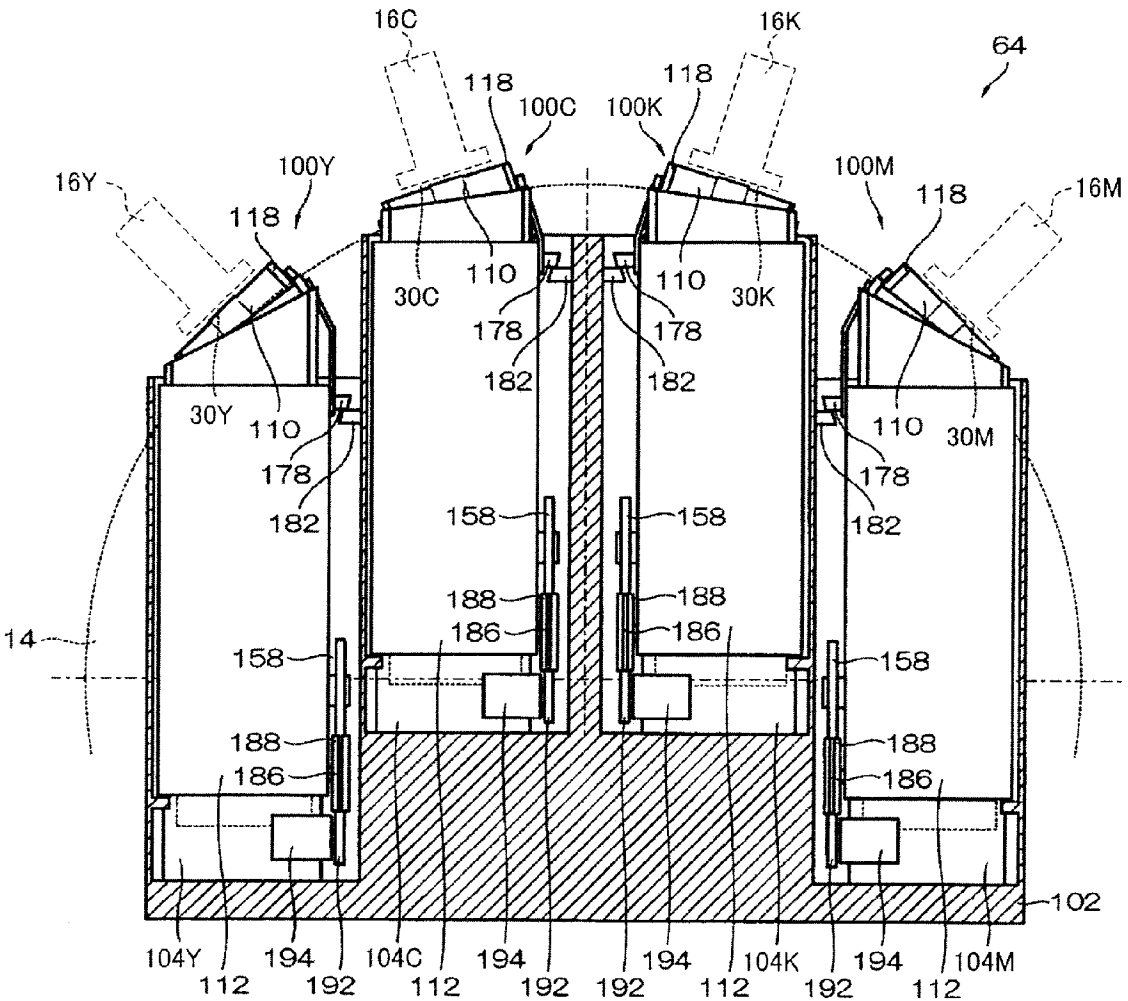
FIG. 11 is a side view diagram showing a wiping device viewed from the maintenance position side.

FIG. 11 is a side view diagram showing a nozzle surface wiping device viewed from the maintenance position side.

As shown in FIG. 11, the nozzle surface wiping device 64 is constituted by wiping units 100M, 100K, 100C, 100Y provided so as to correspond respectively to the inkjet heads 16C, 16M, 16Y, 16K, and a wiping device main frame 102 on which these wiping units 100M, 100K, 100C, 100Y are set.

Composition of Wiping Device Main Frame

The wiping device main frame 102 is disposed horizontally and is provided so as to be raisable and lowerable by an elevator apparatus, which is not illustrated. The wiping device main frame 102 is formed in a box shape having an open upper end portion, and wiping unit installation sections 104M, 104K, 104C, 104Y for installation of the wiping units 100M, 100K, 100C, 100Y are provided inside the main frame 102.

The wiping unit installation sections 104M, 104K, 104C, 104Y are respectively formed as spaces which can accommodate the wiping units 100M, 100K, 100C, 100Y, and the upper portions thereof are open. The wiping units 100M, 100K, 100C, 100Y are set on the respective wiping unit installation sections 104M, 104K, 104C, 104Y by being inserted vertically downwards through the upper openings of the wiping unit installation sections 104M, 104K, 104C, 104Y.

A lock mechanism (not illustrated) is provided on each of the wiping unit installation sections 104M, 104K, 104C, 104Y, in such a manner that the installed wiping units 100M, 100K, 100C, 100Y can be locked. The lock mechanisms are, for example, composed so as to operate automatically when the wiping units 100M, 100K, 100C, 100Y are inserted into the wiping unit installation sections 104M, 104K, 104C, 104Y.

Composition of Wiping Unit

Next, the composition of the wiping units 100M, 100K, 100C, 100Y will be described.

The wiping units 100M, 100K, 100C, 100Y all have the same basic composition and therefore the composition is described here with respect to one wiping unit 100. The same applies to the wiping unit installation sections 104M, 104K, 104C, 104Y, and here one wiping unit installation section 104 is described.

Figure 12:
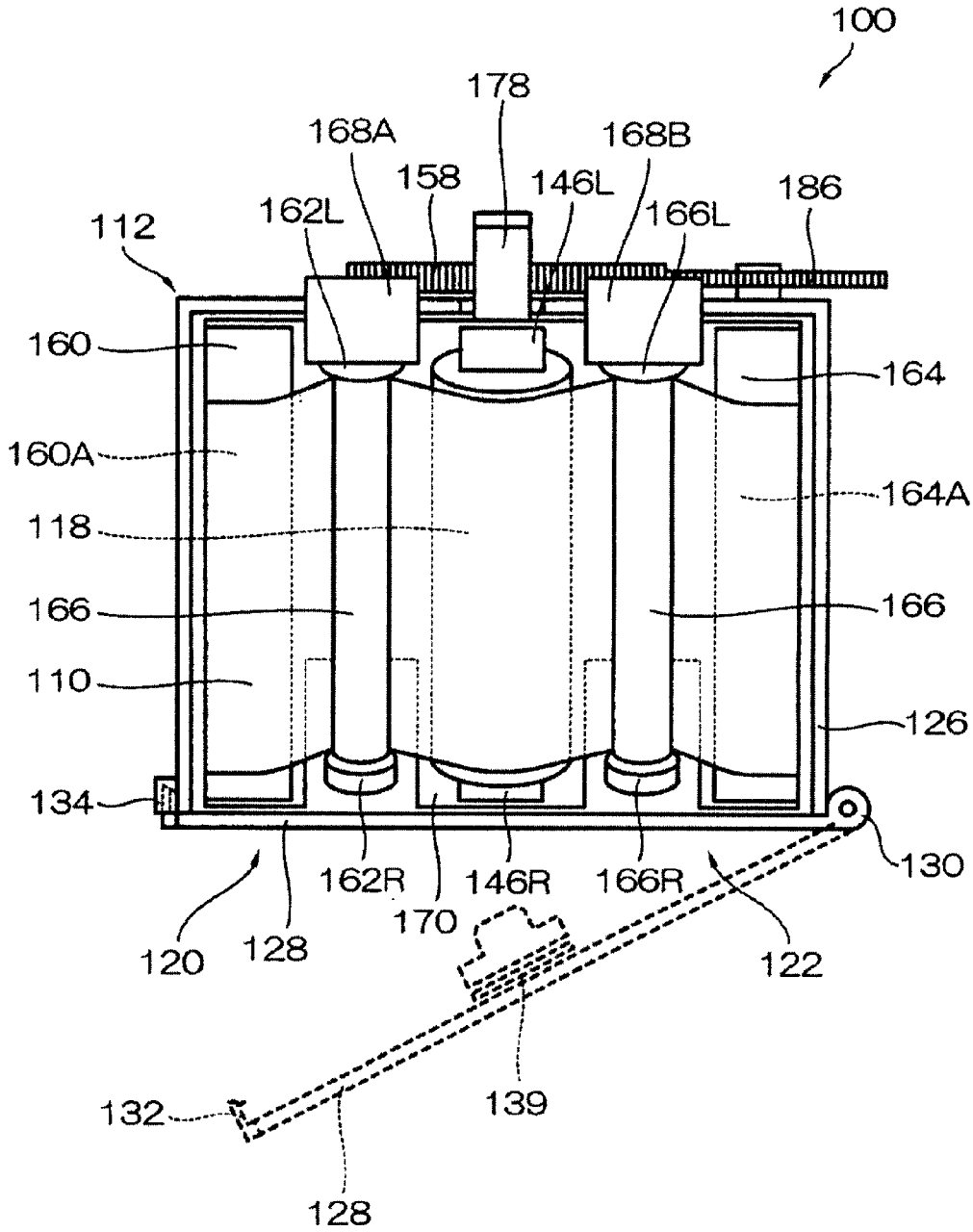
FIG. 12 is a plan diagram of a wiping unit.
Figure 13:
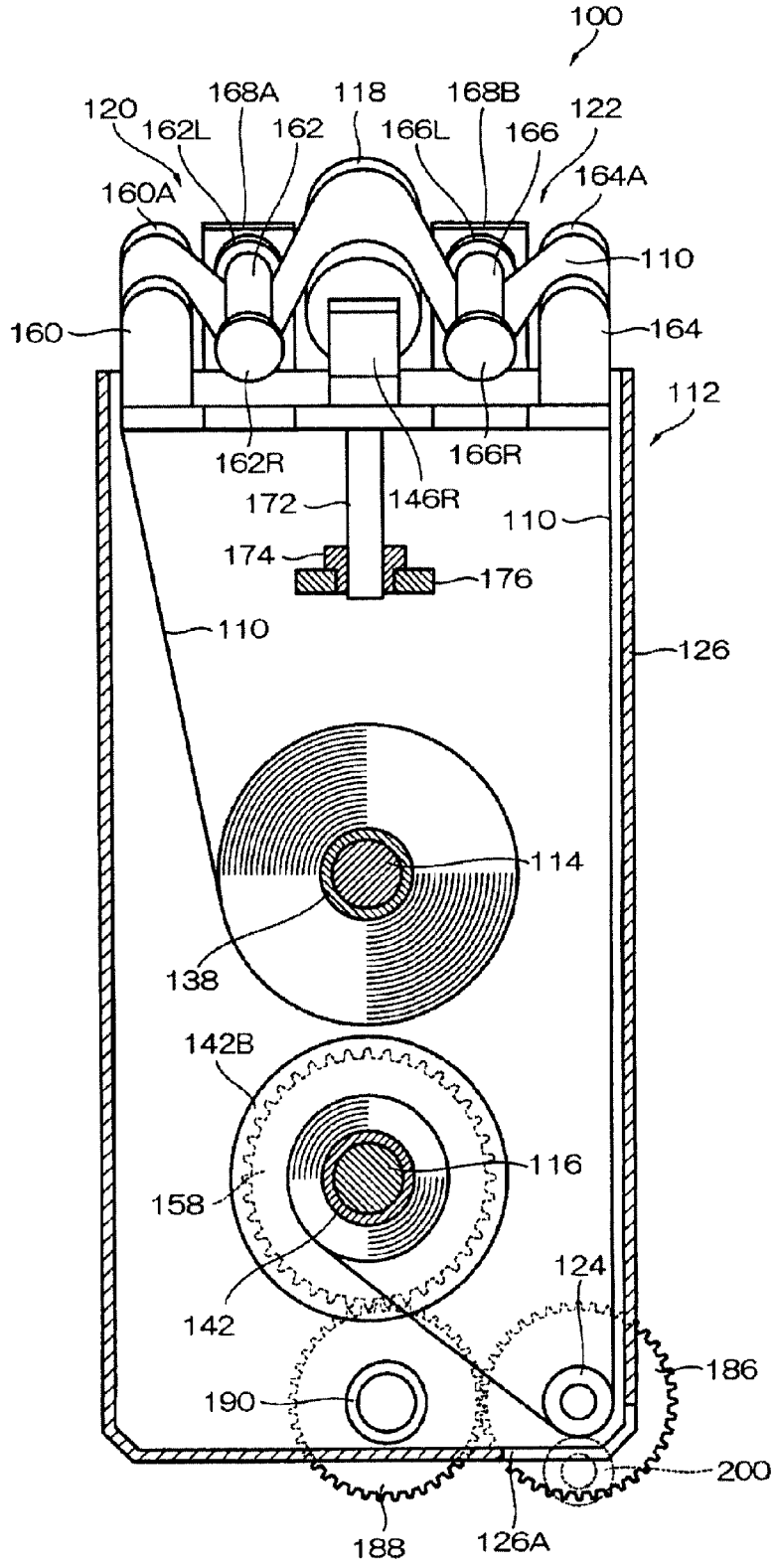
FIG. 13 is a cross-sectional diagram of a front face portion of a wiping unit.

FIG. 12 is a plan diagram of a wiping unit and FIG. 13 is a partial cross-sectional front view of a wiping unit As shown in FIG. 12 and FIG. 13, the wiping unit 100 has a wiping web 110 formed in a band shape which is wrapped about a pressing roller 118 disposed at an inclination, and the wiping unit 100 wipes and cleans the nozzle surface of an inkjet head by pressing and abutting the wiping web 110 wrapped about the pressing roller 118, against the nozzle surface of the inkjet head.

The wiping unit 100 comprises a case 112, a pay-out spindle 114 which pays out the wiping web 110 formed in a band shape, a take-up spindle 116 which takes up the wiping web 110, a front-stage guide 120 which guides the wiping web 110 paid out from the pay-out spindle 114 in such a manner that the wiping web 110 is wrapped about the pressing roller 118, a rear-stage guide 122 which guides the wiping web 110 wrapped about the pressing roller 118 in such a manner that the wiping web 110 is taken up onto the take-up spindle 116, and a grid roller (drive roller) 124 which conveys the wiping web 110.

The pay-out spindle 114 is formed in a round cylindrical shape (i.e. columnar shape) and the base end portion thereof is fixed (supported in cantilever fashion) to a spindle support section 136 provided on the case main body 126, in such a manner that the pay-out spindle 114 is installed horizontally inside the case main body 126. A pay-out core 138 is installed attachably and detachably on this pay-out spindle 114. The pay-out spindle 114 is formed to be slightly shorter than the length of the pay-out core 138. Therefore, when the pay-out core 138 is installed, the pay-out spindle 114 is withdrawn into the inner circumference portion of the pay-out core 138.

The pay-out core 138 is formed in a round cylindrical shape (i.e. cylinder hollow shape). A wiping web 110 formed in a band shape is wound in the form of a roll about this pay-out core 138.

The pay-out core 138 is installed on the pay-out spindle 114 by inserting the pay-out spindle 114 into the inner circumferential portion of the core and thereby fitting the core onto the spindle 114. The pay-out core 138 which has been installed on the pay-out spindle 114 rotates about the pay-out spindle 114 and is supported in a rotatable fashion.

The wiping web 110 uses, for example, a knitted or woven sheet made of ultra-fine fibers of PET, PE, NY, acryl, or the like, and is formed in a band shape having a width corresponding to the width of the nozzle surface of the head to be wiped.

The take-up spindle 116 is disposed horizontally at a position below the pay-out spindle 114. More specifically, the take-up spindle 116 and the pay-out spindle 114 are disposed in parallel, one above the other.

A take-up core 142 which takes up the wiping web 110 paid out by the pay-out core 138 is installed on the take-up spindle 116.

The composition of the take-up core 142 is substantially the same as the composition of the pay-out core 138. In other words, the take-up core 142 is formed in a round cylindrical shape (i.e. cylinder hollow shape). The front end of the wiping web 110 wound up on the pay-out core 138 is fixed to this take-up core 142.

The take-up core 142 is installed on the take-up spindle 116 by fitting the take-up spindle 116 into the inner circumference portion of the take-up core 142.

The main shaft of the take-up spindle 116 is provided in such a manner that the base end portion thereof projects outside the case main body 126, and a take-up spindle gear 158 is installed on this projecting base end portion. The take-up spindle 116 (main shaft) is turned by driving and rotating this take-up spindle gear 158.

The pressing roller 118 is disposed above the pay-out spindle 114 (in the present embodiment, the pressing roller 118, the pay-out spindle 114 and the take-up spindle 116 are disposed on the same straight line), and is arranged at a prescribed angular inclination with respect to the horizontal plane. In other words, the pressing roller 118 is obliquely disposed in accordance with the inclination of the nozzle surface 30 of the inkjet head 16 that is to be wiped (so as to be positioned in parallel with the nozzle surface) in order to press and abut the wiping web 110 against the nozzle surface 30 of the inkjet head 16.

The front-stage guide 120 is constituted by a first front-stage guide 160 and a second front-stage guide 162, and the wiping web 110 paid out from the pay-out spindle 114 is guided so as to be wrapped about the pressing roller 118 which is disposed at an inclination.

On the other hand, the rear-stage guide 122 is constituted by a first rear-stage guide 164 and a second rear-stage guide 166, and the wiping web 110 which is wrapped about the pressing roller 118 disposed at an inclination is guided so as to be taken up onto the horizontally disposed take-up spindle 116.

The front-stage guide 120 and the rear-stage guide 122 are disposed symmetrically about the pressing roller 118. More specifically, the first front-stage guide 160 and the first rear-stage guide 164 are disposed symmetrically about the pressing roller 118, and furthermore the second front-stage guide 162 and the second rear-stage guide 166 are disposed symmetrically about the pressing roller 118.

The first front-stage guide 160 is formed in a plate shape having a prescribed width and is erected vertically on the elevator stage 170. The upper edge portion 160A of this first front-stage guide 160 is formed as a wrapping section for the wiping web 110, and the surface thereof is formed in a circular arc shape. Furthermore, the upper edge portion 160A is formed at a prescribed angular inclination with respect to the horizontal plane, whereby the direction of travel of the wiping web 110 is changed.

The first rear-stage guide 164 has the same composition as the first front-stage guide 160. More specifically, the first rear-stage guide 164 is formed in a plate shape having a prescribed width and is erected vertically on the elevator stage 170. The upper edge portion 164A is formed as a wrapping section for the wiping web 110 and is formed in a circular arc shape. Furthermore, the upper edge portion 164A is formed at a prescribed angular inclination with respect to the horizontal plane.

The first front-stage guide 160 and the first rear-stage guide 164 are disposed symmetrically about the pressing roller 118. The wiping web 110 which is paid out from the pay-out spindle 114 is changed in direction to a direction substantially perpendicular to the pressing roller 118 from the direction perpendicular to the pay-out spindle 114, by wrapping about the first front-stage guide 160. The wiping web 110 wrapped about the second rear-stage guide 166 described below is changed in direction to a direction perpendicular to the take-up spindle 116 by wrapping about the first rear-stage guide 164.

The second front-stage guide 162 is constituted by a guide roller having flanges 162L and 162R on the respective end portions thereof. This second front-stage guide 162 is disposed between the first front-stage guide 160 and the pressing roller 118, and guides the wiping web 110 which has wrapped about the first front-stage guide 160 so as to be wrapped about the pressing roller 118. More specifically, the direction of travel of the wiping web 110 which has been changed to a direction substantially perpendicular to the pressing roller 118 by the first front-stage guide 160 is adjusted finely so that the wiping web 110 travels in a direction perpendicular to the pressing roller 118. Furthermore, skewed travel of the wiping web 110 is prevented by the flange sections 162L and 162R on the respective ends.

Figure 15:
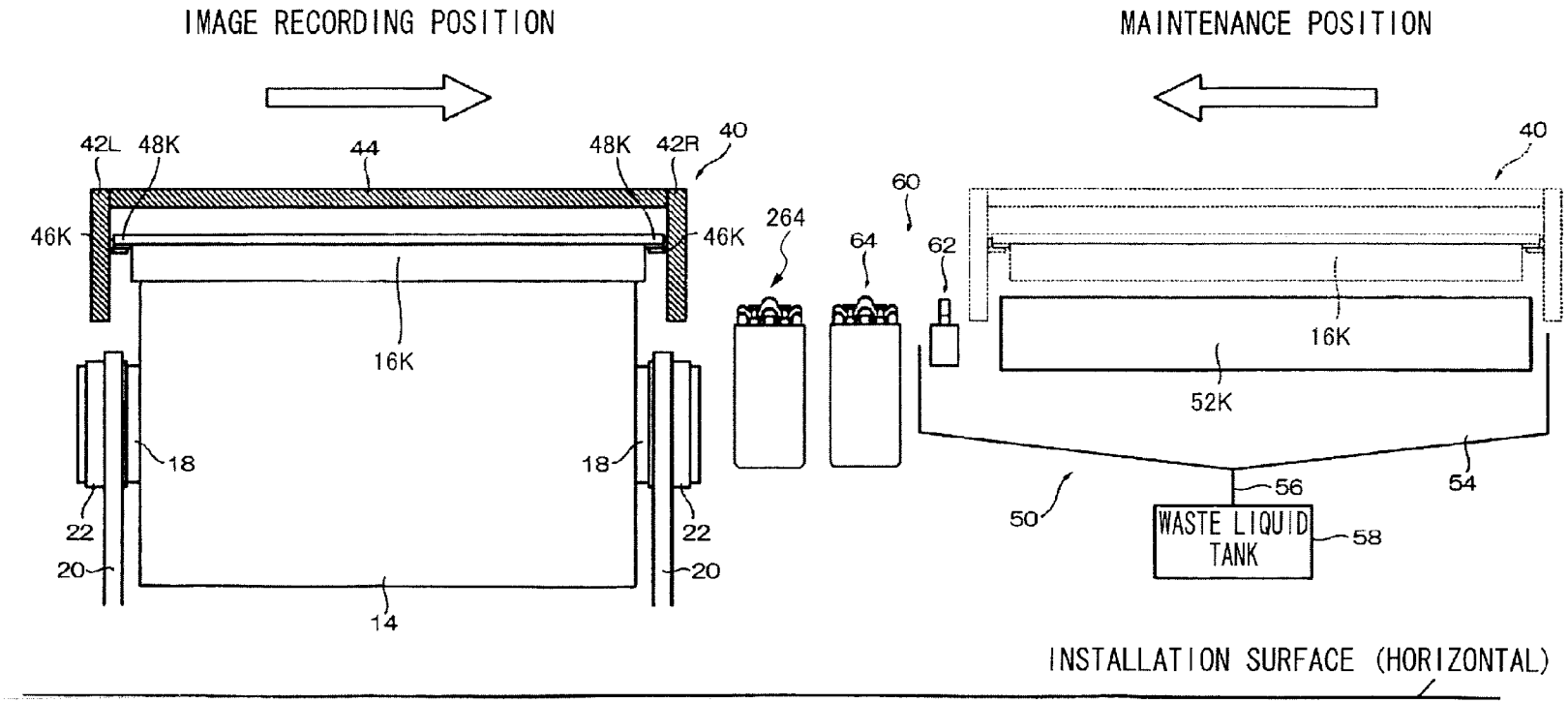
FIG. 15 is a front view diagram of an image recording unit showing a further example of an inkjet recording apparatus.

One end of this second front-stage guide 162 is supported in a cantilever fashion on a bracket 168A and the second front-stage guide 162 is provided to have a prescribed angular inclination. As shown in FIG. 12 and FIG. 15, the bracket 168A is formed in a plate shape with a bent front end, and the base end portion thereof is fixed to the upper end portion of the rear face of the case main body 126. The bracket 168A is provided so as to project vertically upwards from the upper end portion of the case main body 126. The second front-stage guide 162 is supported rotatably in a cantilever fashion on the bent portion of the front end of the bracket 168A.

The second rear-stage guide 166 has the same composition as the second front-stage guide 162. More specifically, the second rear-stage guide 166 is constituted by a guide roller having flanges 166L and 166R on either end portion thereof, and one end thereof is supported in a cantilever fashion on a bracket 168B. The second rear-stage guide 166 is provided at a prescribed angular inclination. The bracket 168B is formed in a plate shape with a bent front end, and the base end portion thereof is fixed to the upper end portion of the rear face of the case main body 126. The second rear-stage guide 166 is supported rotatably in a cantilever fashion on the bent portion of the front end of the bracket 168B.

This second rear-stage guide 166 is disposed between the pressing roller 118 and the first rear-stage guide 164, and guides the wiping web 110 which has wrapped about the pressing roller 118 so as to be wrapped about the first rear-stage guide 164.

The second front-stage guide 162 and the second rear-stage guide 166 are disposed symmetrically about the pressing roller 118. The wiping web 110 which has been changed to a direction substantially perpendicular to the pressing roller 118 by the first front-stage guide 160 is wrapped about the second front-stage guide 162, whereby the direction of travel of the wiping web 110 is adjusted finely so as to travel in a direction perpendicular to the pressing roller 118. Furthermore, the direction of travel of the wiping web 110 wrapped about the pressing roller 118 is adjusted finely by the second rear-stage guide 166 so as to wrap about the first rear-stage guide 164. By wrapping about the first rear-stage guide 164, the direction of travel is changed to a direction perpendicular to the take-up spindle 116.

In this way, the front-stage guide 120 and the rear-stage guide 122 guide the wiping web 110 by changing the direction of travel of the wiping web 110 in a stepwise direction, so that the wiping web 110 wraps about the pressing roller 118 readily.

Consequently, the angle of inclination of the second front-stage guide 162 is closer to the angle of inclination of the pressing roller 118 than the angle of inclination of the first front-stage guide 160, and similarly, the angle of inclination of the second rear-stage guide 166 is closer to the angle of inclination of the pressing roller 118 than the angle of inclination of the first rear-stage guide 164.

In the present embodiment of the present invention, since cleaning liquid is held in the wing sections 30B and wiping is performed by a wiping web, then cleaning liquid may be left in the wing sections 30B after wiping. If there is cleaning liquid remaining on the wing sections 30B, the cleaning liquid drops down onto the recording medium and the image recording drum, and so on, and there is a possibility of problems. Consequently, it is desirable to wipe away the cleaning liquid on the wing sections 30B.

Figure 14B:
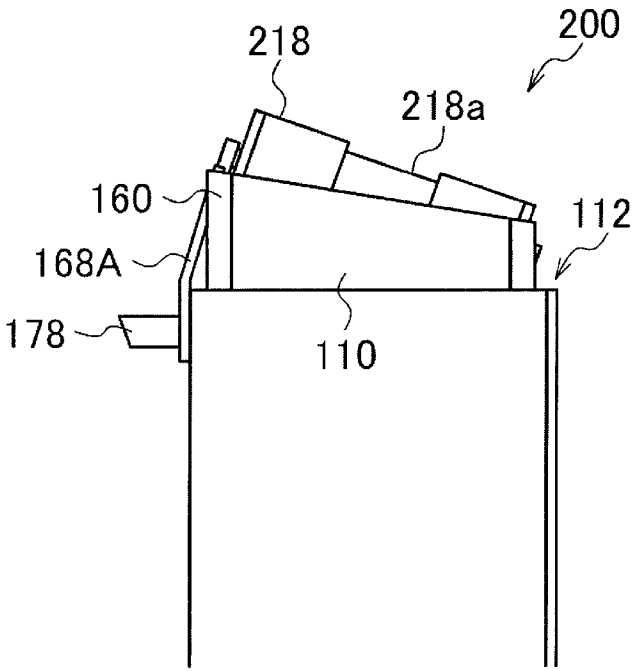
FIG. 14A is a perspective diagram of a pressing roller which is used in a wing section wiping device and FIG. 14B is a side view diagram of a wiping unit viewed from the side of the image recording position.
Figure 14A:
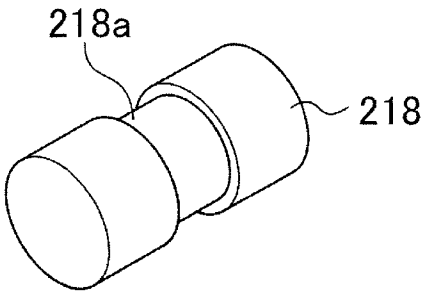

The method of wiping the wing sections 30B can use a pressing roller 218 having a step difference 218*a* with a reduced central portion of the roller, as shown in FIG. 14A, for example. By providing a step difference 218*a*, it is possible to abut the pressing roller 218 against the wing sections 30B only, via the wiping web. Since pressure is not applied to the location where the step difference 218*a* is formed, only the wing sections 30B can be wiped. FIG. 14B is a side view diagram showing the pressing roller 218 in FIG. 14A installed in the wiping unit 200. By using a pressing roller 218 provided with a step difference 218*a*, it is possible to replace only the pressing roller 218 and to perform wiping of the wing sections 30B by using a wiping web of the same size.

If a wing section wiping device 264 which wipes only the wing sections 30B is provided, then it is possible to wipe away cleaning liquid from the wing sections 30B by providing a wing section wiping device 264 in series after performing wiping of the nozzle plate 30A and the wing sections 30B by the nozzle surface wiping device 64, as shown in FIG. 15. By wiping only the wing sections 30B, it is possible to prevent deterioration of the hydrophobic film of the nozzle plate 30A when wiping away surplus cleaning liquid.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet head comprising:

a plurality of nozzle plates which are arranged in a width direction of a recording medium and each of which has a plurality of nozzles for ejecting ink and has a hydrophobic property; and cleaning liquid holding members which are provided respectively on both sides of the plurality of nozzle plates in terms of a direction perpendicular to a direction of arrangement of the plurality of nozzle plates so as to extend substantially in parallel with the direction of arrangement of the plurality of nozzle plates, and which have a lower hydrophobic property than the plurality of nozzle plates, wherein the cleaning liquid holding members include a cleaning liquid holding mechanism for holding cleaning liquid; and wherein the cleaning liquid holding mechanism is constituted by groove sections formed in the cleaning liquid holding members.

2. The inkjet head as defined in claim 1, wherein the groove sections are formed substantially in parallel with the direction of arrangement of the plurality of nozzle plates.

3. The inkjet head as defined in claim 1, wherein from among the groove sections provided on the both sides of the plurality of nozzle plates, the groove section on one side has a guidance groove extending towards the plurality of nozzle plates, and the groove section on another side has a groove extending in a different direction from the guidance groove.

4. The inkjet head as defined in claim 1, wherein:

the plurality of nozzle plates have a nozzle surface provided at an inclination with respect to a horizontal plane, and a volume of the groove sections, formed in the cleaning liquid holding members, becomes larger as an angle of inclination of the nozzle surface increases.

5. An inkjet head cleaning system comprising:

the inkjet head as defined in claim 1;

a cleaning liquid deposition device which supplies the cleaning liquid to the plurality of nozzle plates and the cleaning liquid holing members of the inkjet head; and a wiping device which wipes the plurality of nozzle plates of the inkjet head.

6. The inkjet head cleaning system as defined in claim 5, wherein the wiping device includes a first cleaning member for wiping the plurality of nozzle plates, and a second cleaning member for wiping only the cleaning liquid holding members.

7. A maintenance method of an inkjet head, comprising the steps of:

moving an inkjet head having a nozzle surface formed by a nozzle plate and a cleaning liquid holding member;

depositing cleaning liquid on the nozzle surface of the inkjet head;

causing the cleaning liquid to be held on the cleaning liquid holding member of the inkjet head; and wiping the nozzle plate while causing the cleaning liquid held on the cleaning liquid holding member to be transferred by a wiping member;

wherein the cleaning liquid holding member is provided on a side of the nozzle plate in terms of a direction perpendicular to a direction of arrangement of the nozzle plate so as to extend substantially in parallel with the direction of arrangement of the nozzle plate, and which has a lower hydrophobic property than the nozzle plate, wherein the cleaning liquid holding member includes a cleaning liquid holding mechanism for holding cleaning liquid; and wherein the cleaning liquid holding mechanism is constituted by groove sections formed in the cleaning liquid holding member.

8. The maintenance method of an inkjet head as defined in claim 7, further comprising the step of wiping only the cleaning liquid holding member, after wiping the nozzle plate.

* * * * *